148-162 AJ 111 EX
6/30/87 OR 4,676,846

United States Patent [19]
Harf

[11] Patent Number: 4,676,846
[45] Date of Patent: Jun. 30, 1987

[54] HEAT TREATMENT FOR SUPERALLOY

[75] Inventor: Fredric H. Harf, Berea, Ohio

[73] Assignee: The United States of America as represented by the Administrator of the National Aeronautics and Space Administration, Washington, D.C.

[21] Appl. No.: 832,296

[22] Filed: Feb. 24, 1986

[51] Int. Cl.[4] ..... C22F 1/10
[52] U.S. Cl. ..... 148/162; 148/410
[58] Field of Search ..... 148/162, 409, 410

[56] References Cited

U.S. PATENT DOCUMENTS 2,570,194 10/1951 Bieber et al. ..... 148/162
3,272,666 9/1966 Symonds ..... 148/13
3,536,542 10/1970 Murphy et al. ..... 148/162
4,161,412 7/1979 Henry ..... 148/3

*Primary Examiner*—R. Dean
*Attorney, Agent, or Firm*—Gene E. Shook; John R. Manning

[57] ABSTRACT

A cobalt-free nickel-base superalloy composed of in weight % 15 Cr-5 Mo-3.5 Ti-4 Al-0.07 (max) C-remainder Ni is given a modified heat treatment. With this heat treatment the cobalt-free alloy achieves certain of the mechanical properties of the corresponding cobalt-containing nickel-base superalloy at 1200° F. (650° C.). Thus strategic cobalt can be replaced with nickel in the superalloy.

13 Claims, 1 Drawing Figure

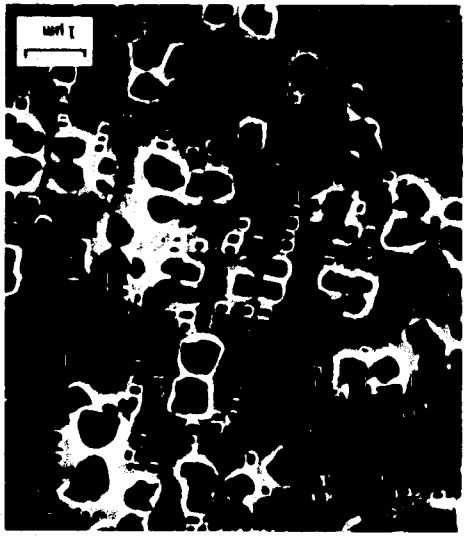
1 μm

HEAT TREATMENT FOR SUPERALLOY

ORIGIN OF THE INVENTION

The invention described herein was made by an employee of the U.S. Government and may be manufactured and used by or for the government for governmental purposes without the payment of any royalties thereon or therefor.

TECHNICAL FIELD

This invention is concerned with an improved method of heat treating a nickel-base superalloy. The invention is particularly directed to heat treating such a superalloy that is cobalt free to obtain stress rupture properties at 1200° F. (650° C.) equal or superior to those of a commercial superalloy containing 17% cobalt.

Certain nickel-base superalloys are used in the hot sections of jet engines. These superalloys contain cobalt which must be imported from foreign sources, and cobalt is one of the most critical strategic materials. It is desirable to reduce the consumption of cobalt.

A commercially available nickel-base superalloy known as Udimet 700 contains about 17 weight percent cobalt. This alloy is heat treatable, and normally it is used as a cast plus wrought (CW) product in aircraft gas turbine components. The alloy also can be gas-atomized into a prealloyed powder-metallurgy (PM) product. This product can be consolidated in a hot isostatically pressed powder metallurgy (HIP-PM) form, such as a turbine disk. Such jet engine parts are exposed to both high stresses and temperatures to 1400° F. (760° C.).

The strategic cobalt in this alloy can be replaced with nickel in both the cast plus wrought (CW) and hot isostatically pressed powder metallurgy (HIP-PM) forms. It is, therefore, an object of the present invention to achieve certain of the mechanical properties of the cobalt containing nickel-base superalloys in a cobalt-free superalloy through an improved heat treatment.

BACKGROUND ART

A heat treatment for a nickel-base alloy is described in U.S. Pat. No. 3,536,542 to Murphy et al. The heat treatment comprises heating the alloy to a temperature of about 2100° F. to about 2200° F. for 2 to 8 hours. This heating is followed by fast cooling, and then treating at a temperature of about 1975° F. for about 2 to 8 hours. Again the alloy is fast cooled and then treated at a temperature of about 1700° F. from 12 to 48 hours. This is followed by fast cooling and treating at a temperature of about 1400° F. from 8 to 25 hours. The alloy is then fast cooled.

U.S. Pat. No. 4,161,412 to Henry discloses a method of heat treating a gamma/gamma-prime-alpha eutectic nickel-base superalloy by heating the alloy to a temperature at which at least a portion of the gamma-prime phase will transform to a gamma-phase. The resulting heated body is maintained at this temperature to facilitate the transformation of at least a portion of the gamma-prime phase to a gamma-phase. The resulting transformed body is cooled to a temperature at which at least a portion of the gamma-phase precipitates to a modified gamma-prime phase.

U.S. Pat. No. 3,272,666 to Symonds discloses a method of heat treating nickel-base alloy articles which comprises heating the alloy over a period of not more than 70 seconds nor less than 15 seconds to a temperature in the range from 1975° F. to 2200° F. for a sufficient time to effect solution of the gamma-prime phase. After rapid cooling, the alloy may be rolled, drawn, or otherwise fabricated and then age hardened by prior art methods.

U.S. Pat. No. 2,570,194 to Bieber et al describes a high temperature treating sequence for nickel alloys comprising heating the alloy within a range of about 1950° F. to 2200° F. for at least 1 hour and up to 24 hours or more. This is followed by sufficiently rapid cooling to preserve the solid solution of the age hardening precipitable phases. The alloy may be rapidly cooled by quenching in oil or water, and the alloys are then aged at 1300° to 1500° F. for at least 4 hours and up to 24 hours or more.

DISCLOSURE OF THE INVENTION

The objects of the invention are achieved by a modified heat treatment in which the heat treating temperature is raised to 2090° F. (1145° C.). The superalloy is maintained at this temperature for about 4 hours and then oil quenched.

This heat treatment is followed by a four-stage aging treatment in which the superalloy is first heated to 1600° F. (870° C.) and maintained at this temperature for about 8 hours. After air cooling, the next step is to heat the superalloy to about 1885° F. (1030° C.) and then maintain this temperature for about two hours. This heating is followed by air cooling.

This heating to a temperature higher than used in conventional aging enables ultra fine particles to be formed during the last two aging steps. These last stage include heating to 1200° F. (650° C.) for 16 to 32 hours, preferably 24 hours, followed by air cooling and then heating to 1400° F. (760° C.) for eight hours before air cooling.

DESCRIPTION OF THE DRAWINGS

The drawing is a scanning electron micrograph showing the microstructure of a cobalt-free nickel-base superalloy heat treated in accordance with the present invention.

BEST MODE FOR CARRYING OUT THE INVENTION

Cobalt free CW and HIP-PM alloys were prepared from the same master melt. The composition of the CW alloy, in weight percent, was 15.1 Cr-5.0 Mo-3.5 Ti-4.0 Al-0.06 C-0.025 B-0.11 Fe-less than 0.1 Co and the remainder Ni. The composition of the HIP-PM alloy was 14.9 Cr-5.0 Mo-3.51 Ti-4.12 Al-0.06 C-0.019 B-0.10 Fe and the remainder Ni.

The heat treatment of the present invention was developed for applications of the cobalt-free nickel base superalloy where the ordinary use temperature does not exceed 1300° F. (705° C.) and preferably peaks at about 1200° F. (650° C.). Both sufficient tensile and creep rupture strengths with adequate ductility are required at this peak temperature.

When the strength limits are exceeded the material fails. The mechanism for failure is by cracking, and maximum strength below 1300° F. (705° C.) is obtained when the crack proceeds transgranularly. In this mode the grain boundaries are stronger than the grains themselves.

The strength of the grains can be increased by fine particles of an ordered $Ni_3Al$ phase, called gamma-prime. Numerous ultra fine particles in the 0.02 micrometer size range are more potent for strengthening than larger particles. The ultra fine particles achieve this strengthening by blocking the movement of dislocation through the grains. The movement of the dislocations produces deformation which, in turn, leaves grain vacancies in the crystalline structure which serve as foci for crack initiation. One objective of the heat treatment is, therefore, to block the movement of dislocation by supplying very numerous ultra fine particles.

A second object of the heat treatment is to maintain a fine grain size because the grain boundaries are stronger than the grains themselves. Grains will not grow in the presence of interfering material in the grain boundaries. A gamma-prime phase produces this interference.

The gamma-prime present in this cobalt-free superalloy dissolves completely in the gamma matrix at temperatures above 2170° F. (1190° C.). When the cobalt-free nickel base superalloy is heated to slightly below this temperature not all the gamma-prime is taken into solution. The undissolved gamma-prime agglomerates into larger particles, and a portion of these particles migrates to the boundaries between the grains. These particles, by their presence, prevent grain growth. Therefore the first step of the heat treatment comprises heating the alloy to a temperature of 2090° F. (1145° C.) and maintaining this temperature for four hours to achieve partial solutioning. This partial solutioning temperature is used for both the HIP-PM material and the cast-wrought CW products. This temperature is higher than those proposed for heat treating cobalt-containing nickel-base superalloys.

A four-step aging process causes the gamma-prime to segregate out of solution and form small particles within the grains. This four-step aging process is used for both the CW and HIP-PM alloys.

This aging process comprises heating the alloy to about 1600° F. (870° C.) for about 8 hours. This is followed by air cooling to ambient. The alloy is again heated to 1885° F. (1030° C.) and maintained at this temperature for about two hours. This is followed by air cooling to ambient. The purpose of these two steps is to cause a nucleation of the smaller particles. More particularly the heating of the alloy to 1600° F. (870° C.) nucleates the fine particles. These particles will grow to a size of about 0.2 micrometers in the next step wherein the alloy is heated to 1885° F. (1030° C.) for about 2 hours. This temperature is higher than those proposed for aging cobalt-containing nickel-base superalloys. The step of heating to the 1600° F. (870° C.) for 8 hours also serves to cause a fine distribution of carbides which otherwise would form a grain boundary network with weakening effects.

The third step in the aging process comprises heating the alloy to 1200° F. (650° C.) for 16 to 32 hours. The alloy is preferably maintained at the temperature of 1200° F. (650° C.) for about 24 hours. This is followed by air cooling to room temperature.

The final step in the aging process comprises heating the alloy to about 1400° F. (760° C.) and maintaining this temperature for about eight hours. The alloy again is air cooled to ambient temperature.

These last two steps similarly nucleate and grow the ultra fine 0.02 micrometer particles which contribute especially to the good strength of the alloy at 1200° F. (650° C.). The higher the temperature in the second aging step, i.e, heating to 1885° F. (1030° C.) for two hours, the less gamma-prime forms 0.2 micrometer particles and the more gamma-prime remains in solution to become ultrafine particles in the last step, i.e., heating to 1400° F. (760° C.).

Tests indicated that the 1885° F. (1030° C.) temperature of the second aging step was the most satisfactory for this alloy. This temperature provided an optimum strength and ductility for the alloy. Raising the temperature substantially to, for example, 1920° F. (1050° C.) indicated the necessity for faster cooling rates. This is less desireable for heat treating and aging.

Thus it is evident the aging heat treatment can be considered as being divided into two sequences. Each sequence is comprised of a lower temperature to induce nucleation of the smaller particles and a higher temperature to promote the growth of gamma-prime particles. The sequence of heating to 1600° F. (870° C.) for eight hours nucleates the fine particles. This heating also results in a fine distribution of carbide which otherwise could form a grain boundary network with weakening effects. This is followed by cooling and heating to 1885° F. (1030° C.) for two hours which causes the fine particles to grow to a size of about 0.2 micrometers. More particularly, this sequence produced fine gamma-prime particles while the ultrafine particles formed during the last two aging steps, i.e., heating to 1200° F. (650° C.) for 24 hours, air cooling, and then heating to 1400° F. (760° C.) for eight hours.

The ultrafine particles grew from the residual gamma-prime dissolved in the gamma matrix. Their quantity decreases noticeably with decreasing cobalt content and is explained on the basis of the increase in the thermal gap between the gamma-prime solvus temperature and the maximum aging temperature. As the thermal gap increases, less gamma-prime remains dissolved in the gamma matrix and available for precipitation as ultrafine particles.

The figure shows the microstructure of the cobalt-free nickel-base superalloy heat treated in accordance with the present invention. Tensile yield and ductility in room temperature tests exceeded the test results for the nickel-base superalloy containing 17 weight percent cobalt. At 1200° F. (650° C.) the improvement persisted with good ductility while the strength of the cobalt-free nickel-base superalloy approached that of the nickel-base superalloy containing 17% cobalt. Cobalt-free nickel-base superalloy HIP-PM specimens were tested at 1200° F. (650° C.) in creep rupture with 11960 psi (825 MPa). The results are set forth in the table.

SUMMARY OF CREEP RUPTURE TEST RESULTS AT 1200° F. (650° C.)

| | Specimen A | Specimen B |
|---|---|---|
| Life, hr | 239 | 296 |
| Time, hr, for total strain of - | | |
| 1 percent | 45 | 25 |
| 2 percent | 133 | 117 |
| Mimimum creep rate, $s^{-1}$ | $2.9 \times 10^{-8}$ | $2.5 \times 10^{-8}$ |
| After rupture: | | |
| Elongation, percent | 3.7 | 3.9 |
| Reduction of area, percent | 10.2 | 14.4 |

While the preferred heat treatment has been disclosed and described it will be appreciated that various procedural steps may be altered without departing from the spirit of the invention or the scope of the subjoined claims.

I claim:

1. A method of heat treating a cobalt free nickel base superalloy having a nominal composition, in weight percent, of about 15% Cr-about 5% Mo-about 3.5% Ti-about 4% Al-about 0.07% (max) C and the remainder nickel comprising the steps of achieving partial solutioning of said superalloy by heating the same to a temperature above 2020° F. (1105° C.) and maintaining the same at said temperature for about four hours then oil quenching said heated superalloy, and aging said superalloy by heating said oil quenched superalloy to a temperature of about 1600° F. (870° C.) and maintaining said superalloy at said temperature for about eight hours followed by cooling said superalloy to ambient temperature in air thereby nucleating fine particles, heating said cooled superalloy to a temperature above 1795° F. (980° C.) and maintaining said superalloy at said temperature for about two hours followed by cooling said superalloy to ambient temperature in air to promote growth of fine gamma-prime particles, heating said cooled superalloy to a temperature of about 1200° F. (650° C.) and maintaining said superalloy at said temperature for about 16 hours to about 32 hours followed by cooling said heated superalloy to ambient temperature in air thereby nucleating ultrafine particles, and heating said cooling superalloy to a temperature of about 1400° F. (760° C.) and maintaining said heated superalloy at said temperature for about eight hours followed by cooling said heated superalloy to ambient temperature in air to promote growth of ultrafine particles.

2. A method of heat treating a superalloy as claimed in claim 1 wherein the nickel base superalloy is a cast plus wrought (CW) product.

3. A method of heat treating a superalloy as claimed in claim 1 wherein the nickel base superalloy is a hot isostatically pressed powder metallurgy (HIP-PM) product.

4. A method of heat treating a superalloy as claimed in claim 1 wherein said superalloy is heated to a temperature of about 2090° F. (1145° C.) and maintained at said temperature for about four hours prior to oil quenching.

5. A method of heat treating a superalloy as claimed in claim 1 wherein the superalloy is heated to a temperature of about 1855° F. (1030° C.) subsequent to air cooling to ambient after heating to 1600° F. (870° C.) and maintained at said temperature of about 1855° F. (1030° C. for about two hours.

6. A method of heat treating a superalloy as claimed in claim 5 wherein the superalloy is maintained at about 1200° F. (650° C.) for about 24 hours.

7. A method of heat treating a cobalt free nickel base superalloy having a nominal composition, in weight percent, of about 15% Cr-about 5% Mo-about 3.5% Ti-about 4% Al-up to 0.07% C. and the remainder nickel comprising the steps of achieving partial solutioning of said superalloy by heating the same to a temperature of about 2090° F. (1145° C.) and maintaining the same at said temperature for about four hours then oil quenching said heated superalloy, and aging said superalloy by heating said oil quenched superalloy to a temperature of about 1600° F. (870° C.) and maintaining said heated superalloy at said temperature for about eight hours followed by cooling said superalloy to ambient temperature in air thereby nucleating fine particles, heating said cooled superalloy to a temperature of about 1885° F. (1030° C.) and maintaining said heated superalloy at said temperature for about two hours followed by cooling said heated superalloy to ambient temperature in air to promote growth of fine gamma-prime particles, heating said cooling superalloy to a temperature of about 1200° F. (650° C.) and maintaining said heated superalloy at said temperature for about 16 hours to about 32 hours followed by cooling said heated superalloy to ambient temperature in air thereby nucleating ultrafine particles, and heating said cooled superalloy to a temperature of about 1400° F. (760° C.) and maintaining said heated superalloy at said temperature for about eight hours followed by cooling said heated superalloy to ambient temperature in air to promote growth of ultrafine particles.

8. A method of heat treating a superalloy as claimed in claim 7 wherein the nickel base superalloy is a cast plus wrought (CW) product.

9. A method of heat treating a superalloy as claimed in claim 7 wherein the nickel base superalloy is a hot isostatically pressed powder metallurgy (HIP-PM) product.

10. A method of heat treating a superalloy as claimed in claim 7 wherein ultrafine particles are formed during the steps of heating to about 1200° F. (650° C.), air cooling, and then heating to about 1400° F. (760° C.).

11. A method of heat treating a superalloy as claimed in claim 10 wherein the ultrafine particles have diameters of about 0.02 micrometers.

12. A method of heat treating a superalloy as claimed in claim 7 wherein the superalloy is maintained at about 1200° F. (650° C.) for about 24 hours.

13. A superalloy heat treated in accordance with the method of claim 1.

* * * * *

UNITED STATES PATENT AND TRADEMARK OFFICE

CERTIFICATE OF CORRECTION

PATENT NO. : 4,676,846

DATED : June 30, 1987

INVENTOR(S) : Fredric H. Harf

It is certified that error appears in the above-identified patent and that said Letters Patent is hereby corrected as shown below:

Column 6, line 24, cancel "cooling" and insert --cooled--.

Signed and Sealed this

Thirty-first Day of May, 1988

*Attest:*

DONALD J. QUIGG

*Attesting Officer*

*Commissioner of Patents and Trademarks*